US006814128B2

(12) United States Patent
Nien

(10) Patent No.: US 6,814,128 B2
(45) Date of Patent: Nov. 9, 2004

(54) VERTICAL RETRACTABLE BLIND

(75) Inventor: Ming Nien, Changhua Hsien (TW)

(73) Assignee: Nien Made Enterprise Co., Ltd., Taichung (TW)

( * ) Notice: Subject to any disclaimer, the term of this patent is extended or adjusted under 35 U.S.C. 154(b) by 0 days.

(21) Appl. No.: 10/291,402

(22) Filed: Nov. 12, 2002

(65) Prior Publication Data

US 2004/0020605 A1 Feb. 5, 2004

(30) Foreign Application Priority Data

Aug. 5, 2002 (TW) ..... 91212386 U

(51) Int. Cl.[7] ..... E06B 3/94
(52) U.S. Cl. ..... 160/84.06; 160/84.03
(58) Field of Search ..... 160/84.06, 84.03, 160/84.04, 84.05, 84.01, 89, 279

(56) References Cited

U.S. PATENT DOCUMENTS 4,473,101 A * 9/1984 Langeler ..... 160/84.06
4,557,309 A * 12/1985 Judkins ..... 160/84.06
4,687,038 A * 8/1987 Clemente ..... 160/84.06
4,733,711 A * 3/1988 Schon ..... 160/84.06
4,762,159 A * 8/1988 Ford ..... 160/279 X
4,850,414 A * 7/1989 Lessard ..... 160/84.06
4,953,610 A * 9/1990 Phillips et al. ..... 160/84.06
5,195,569 A * 3/1993 Peterson et al. ..... 160/84.06
5,533,559 A * 7/1996 Judkins ..... 160/84.06
6,516,856 B2 * 2/2003 Lai ..... 160/89

* cited by examiner

*Primary Examiner*—David Purol
(74) *Attorney, Agent, or Firm*—Bacon & Thomas, PLLC

(57) ABSTRACT

A vertical retractable blind. The blind includes a fixed headrail, a lifting rail vertically movable in the horizontal direction below the headrail, two positioning cords adapted to support the lifting rail at the desired elevation. The positioning cords each have a first end connected to the headrail and a second end respectively extended across the lifting rail and fixedly secured to a respective fixed point outside the lifting rail to provide a tension force to the lifting rail. A retractable blind body is connected between the headrail and the lifting rail and vertically extended out/received subject to vertical movement of the lifting rail.

9 Claims, 8 Drawing Sheets

VERTICAL RETRACTABLE BLIND

BACKGROUND OF THE INVENTION

1. Field of the Invention

The present invention relates to blinds and, more specifically, to a vertical retractable blind.

2. Description of the Related Art

A vertically adjustable blind generally comprises a headrail, a bottom rail suspended below the headrail, and a blind body connected between the headrail and the bottom rail. Except the advanced motor-driven designs, a vertically adjustable blind further comprises a lift cord suspended from the headrail at one side for operation by hand to control the elevation of the bottom rail.

Further, conventional vertically adjustable blinds commonly include two types. The first type (for example, a Venetian blind) has parallel slats that are arranged in a stack when the blind received, or spaced apart when the blind extended out. The second type (for example, a pleated blind or honeycomb shade) has a single sheet of blind body formed of a piece of cloth or paper coated with a coating and folded into pleats. These two types of vertical adjustable blinds have different effects. A Venetian blind can be controlled to tilt the slats so as to regulate the light. A pleated blind or honeycomb shade is adapted to soften the light. However, conventional pleated or honeycomb blinds cannot be used to regulate light as a Venetian blind does. Further, because the lift cords of conventional blinds are exposed to the outside, they destroy the sense of beauty of the blind, and children can reach the exposed lift cord easily. An accident may occur when a child pulling the lift cord of a blind for fun.

SUMMARY OF THE INVENTION

The present invention has been accomplished under the circumstances in view. It is the main object of the present invention to provide a vertical retractable blind, which keeps the cord members concealed and out of reach of children.

It is another object of the present invention to provide a vertical retractable blind, which enables the user to extend or receive the blind easily.

It is still another object of the present invention to provide a vertical retractable blind, which has a simple structure.

It is still another object of the present invention to provide a vertical retractable blind, which provides versatile functions.

According to one embodiment of the present invention, the vertical retractable blind comprises a headrail transversely fastened to the top side of the window, a lifting rail extended in transverse direction below said headrail and vertically movable relative to said headrail, and two positioning cords. The positioning cords each have a first end connected to said headrail and a second end respectively extended across said lifting rail and fixedly secured to a respective fixed point outside said lifting rail to provide a tension force to said lifting rail. A blind body is connected between said headrail and said lifting rail and vertically extended out/received subject to vertical movement of said lifting rail. The main blind body has a plurality of transverse pleats arranged in parallel.

According to an alternate form of the present invention, the vertical retractable blind further comprises a bottom rail fixedly provided below the lifting rail to secure the second ends of the positioning cords, and a supplementary blind body provided between the lifting rail and the headrail.

DETAILED DESCRIPTION OF THE PREFERRED EMBODIMENT

Figure 1:
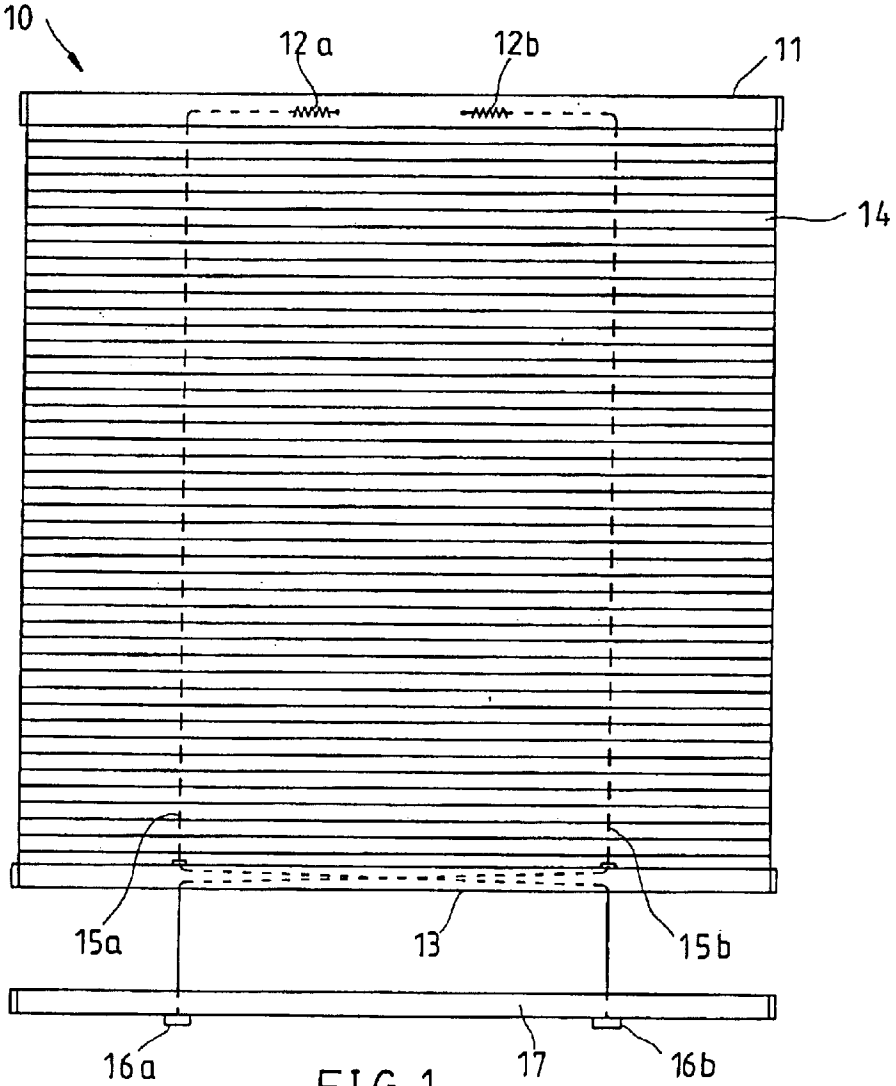
FIG. 1 is a schematic structural view of the first preferred embodiment of the present invention, showing the lifting rail moved to about the lowest position.
Figure 2:
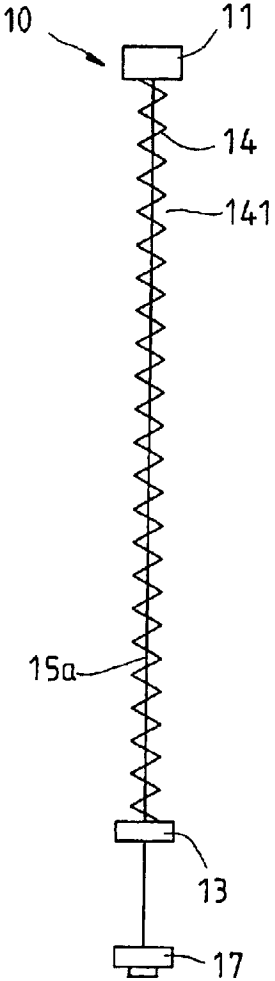
FIG. 2 is a side view of the first preferred embodiment of the present invention.
Figure 3:
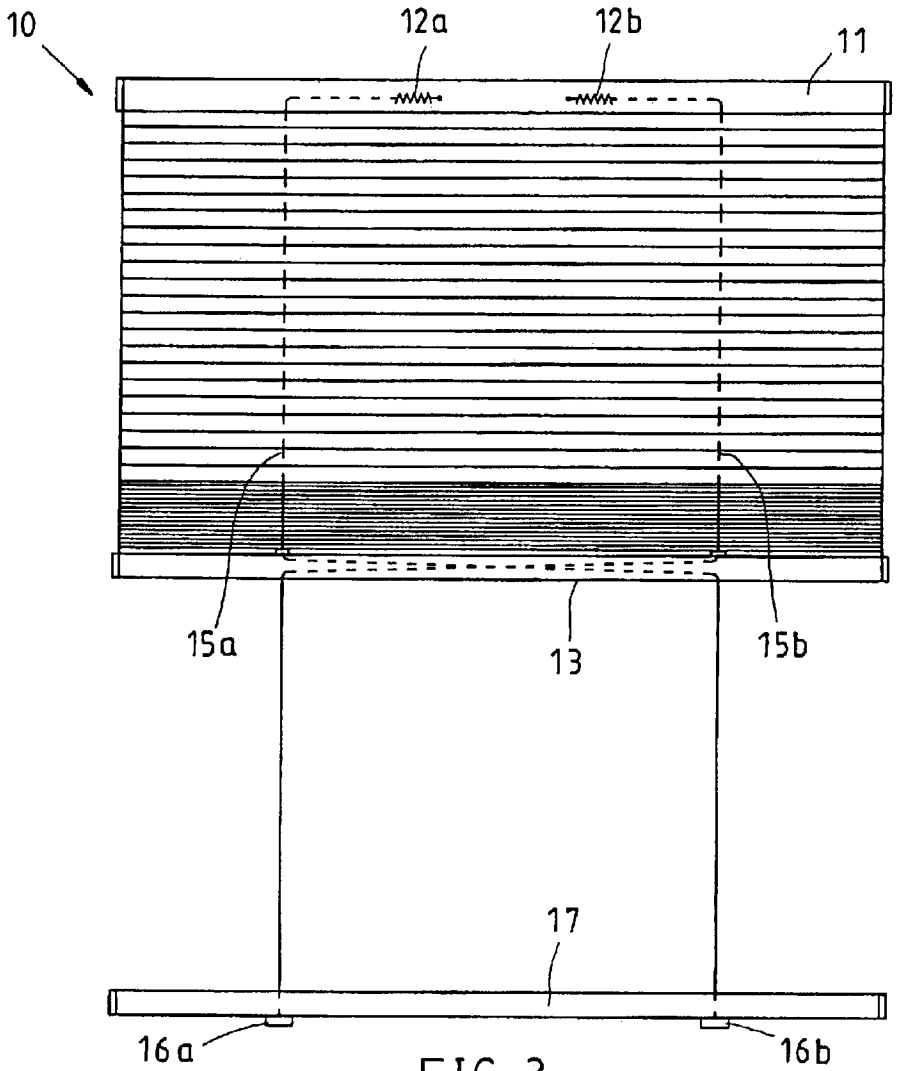
FIG. 3 is another schematic structural view of the first preferred embodiment of the present invention, showing the lifting rail moved to about the mid point position.

Referring to FIGS. 1–3, a vertical retractable blind 10 is shown comprising a headrail 11, a lifting rail 13, a blind body 14, a bottom rail 17, and two positioning cords 15*a* and 15*b*.

The headrail 11 is fixedly transversely (horizontally) fastened to the top side of the window, having a first extension spring 12*a* and a second extension spring 12*b* bilaterally provided on the inside and horizontally aligned in line. The extension springs 12*a* and 12*b* each have an inner end respectively fixedly fastened to a part inside the headrail 11. The other end of each of the extension springs 12*a* and 12*b* is defined as a connecting end.

The lifting rail 13 is a hollow transverse rod member arranged below the headrail 11.

The blind body 14 is provided between the headrail 11 and the lifting rail 13. As illustrated in FIG. 2, the blind body 14 is a pleated sheet member (formed of a piece of coating-coated cloth or fabric and alternatively reversely folded into shape), forming a plurality of transverse pleats 141.

The bottom rail 17 is fixedly transversely (horizontally) fastened to the bottom side of the window below the lifting rail 13. Bracket means may be used to fixedly secure the bottom rail 17 to the bottom side of the window.

The positioning cords 15*a* and 15*b* are bilaterally symmetrically arranged in parallel between the headrail 11 and the bottom rail 17 and inserted through the lifting rail 13. According to this embodiment, the positioning cords 15*a* and 15*b* each have a top end respectively connected to the connecting ends of the extension springs 12*a* and 12*b* in the headrail 11 and a bottom end respectively connected to the tension control members 16*a* and 16*b* at the bottom rail 17. The tension control members 16*a* and 16*b* can be controlled to roll up the positioning cords 15*a* and 15*b*, so as to relatively adjust the tension of the positioning cords 15*a* and 15*b*. As indicated in FIG. 1, one positioning cord, namely, the first positioning cord 15*a* is extended horizontally leftwards in the headrail 11 from the connecting end of the first extension spring 12*a* and then vertically turned downwards to the outside of the headrail 11, and then vertically downwardly extended through the blind body 14 into the inside of the lifting rail 13, and then extended horizontally rightwards in the lifting rail 13 toward the right end of the lifting rail 13, and then vertically downwardly extended out of the lifting rail 13 toward the bottom rail 17 and then connected to the second tension control member 16*b*. The other positioning cord, namely, the second positioning cord 15*b* is extended horizontally rightwards in the headrail 11 from the connecting end of the second extension spring 12*b* and then vertically turned downwards to the outside of the headrail 11, and then vertically downwardly extended through the blind body 14 into the inside of the lifting rail 13, and then extended horizontally leftwards in the lifting rail 13 toward the left end of the lifting rail 13, and then vertically downwardly extended out of the lifting rail 13 toward the bottom rail 17, and then connected to the first tension control member 16*a*. Because the tension control members 16*a* and 16*b* are obtained from conventional techniques and not within the scope of the claims of the present invention, no further detailed description in this regard is necessary.

The aforesaid statement describes the structure of the vertical retractable blind according to the first embodiment of the present invention. Normally, the tension force of the positioning cords 15*a* and 15*b* supports the lifting rail 13 at an elevation, and at the same time the user can hold the lifting rail 13 in horizontal and move it upwards or downwards. When the user released the hand from the lifting rail 13, the lifting rail 13 is held at the adjusted elevation. When moving the lifting rail 13 upwards/downwards, the blind body 14 is relatively folded up/extended out.

Further, because the vertical retractable blind 10 keeps the cords 15*a* and 15*b* out of reach of children, it is safety in use.

According to the aforesaid embodiment, the first ends (the top ends) of the positioning cords 15*a* and 15*b* are respectively connected to the connecting ends of the extension springs 12*a* and 12*b* in the headrail 11, so that the positioning cords 15*a* and 15*b* have a sufficient tension force to support the lifting rail 13 at a particular elevation and to let the lifting rail 1*b* be movable between the headrail 11 and the bottom rail 17 by the user. Alternatively, the extension springs 12*a* and 12*b* can be respectively installed in the two ends of the headrail 11. In this case, the outer end of each extension spring 12*a* or 12*b* is fixedly fastened to the headrail 11, and the inner end of each extension spring 12*a* and 12*b* is connected to the corresponding positioning cord 15*a* or 15*b*. It is also applicable to fixedly secure the first ends (top ends) of the positioning cords 15*a* and 15*b* to the headrail 11, and to connect the second ends (bottom ends) of the positioning cords 15*a* and 15*b* to a respective extension spring in the bottom rail 17. The positioning cords 15*a* and 15*b* can be made of elastic cord members without existence of the extension springs. The extension springs can be eliminated even if the positioning cords have no elasticity. Further, the aforesaid tension control members 16*a* and 16*b* are not requisite members of the vertical retractable blind 10, and can be eliminated.

In the aforesaid first embodiment of the present invention, the blind body 14 is constructed subject to the design of a pleated blind. Alternatively, the blind body 14 can be constructed subject to the design of a Honeycomb shade.

Figure 4:
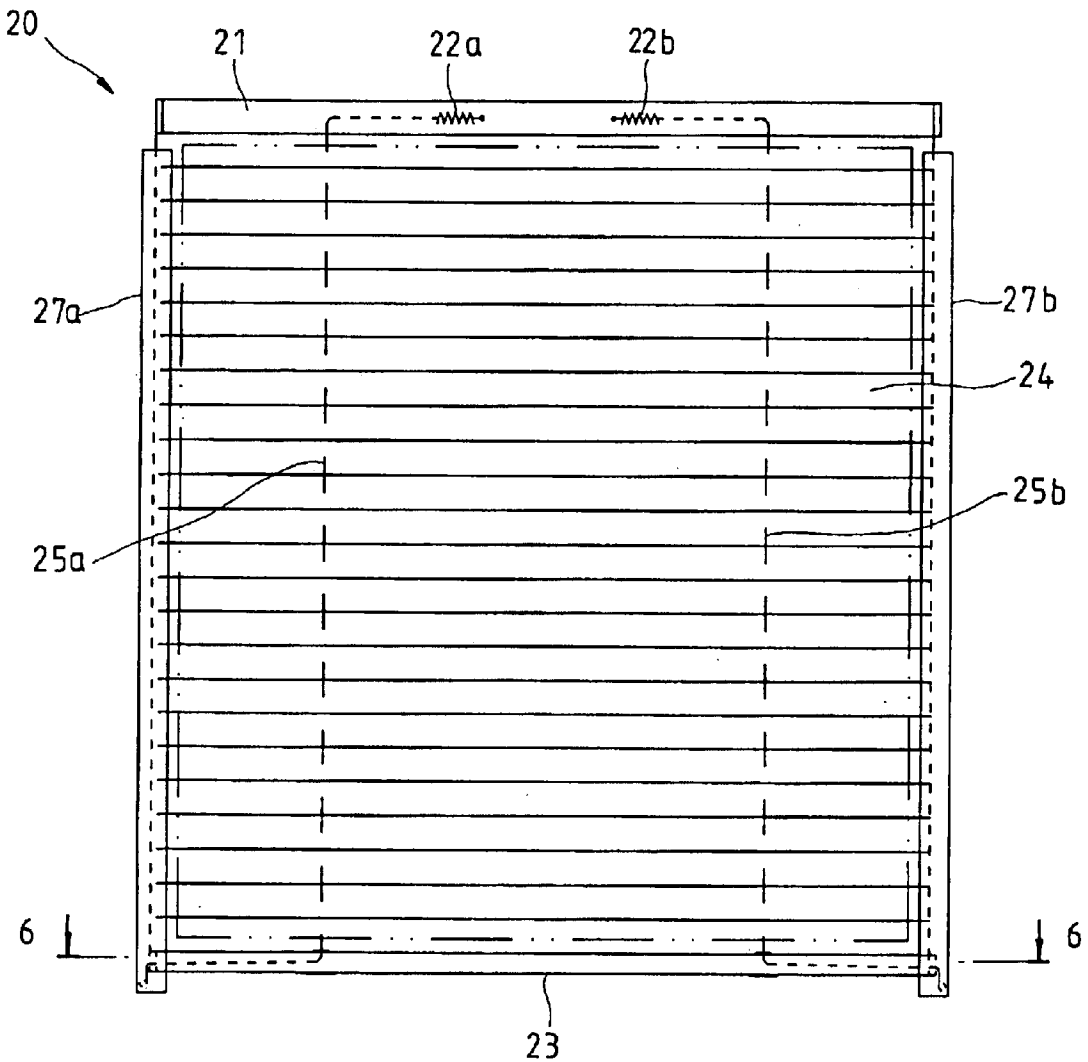
FIG. 4 is a schematic structural view of the second preferred embodiment of the present invention, showing the lifting rail moved to about the lowest position.
Figure 5:
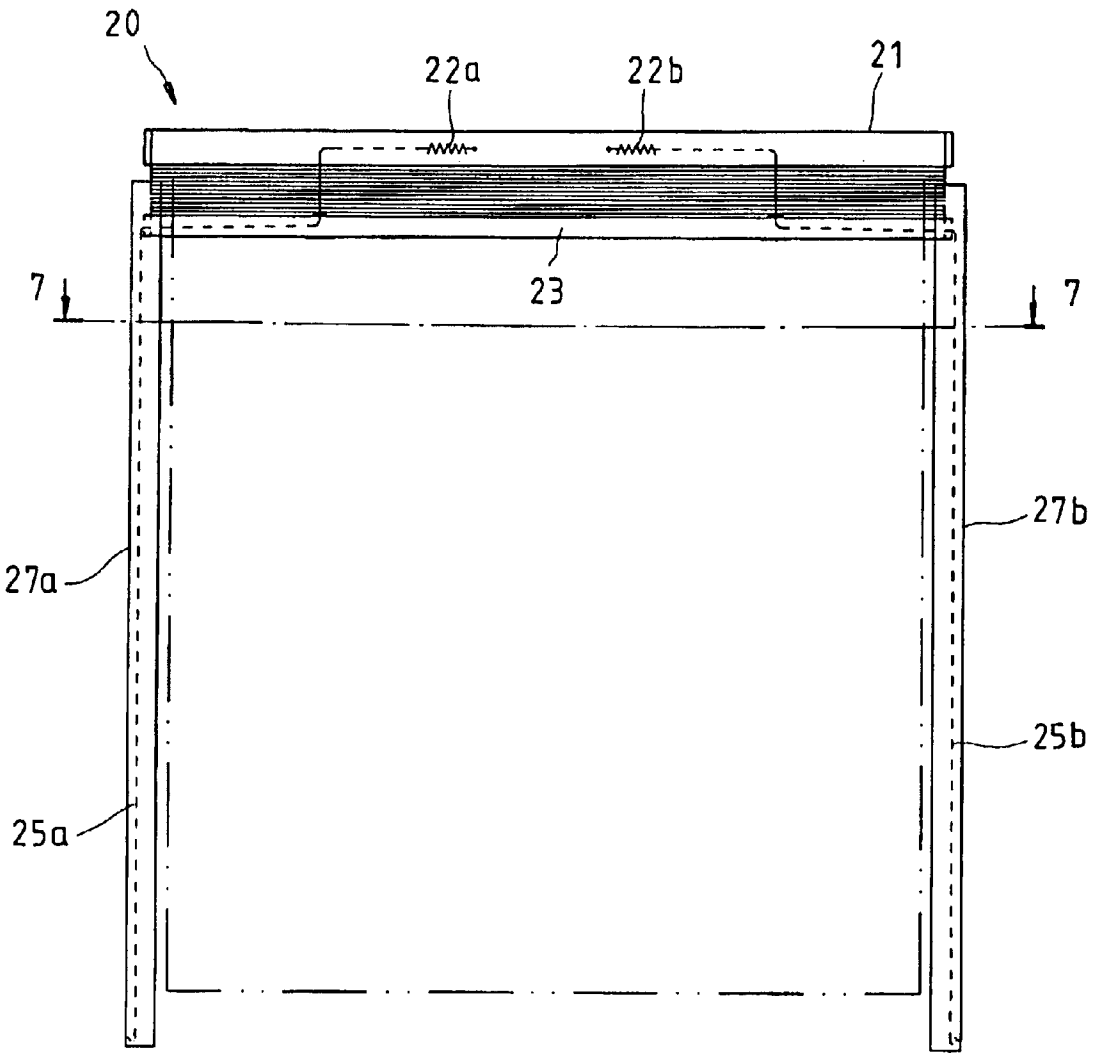
FIG. 5 is another schematic structural view of the second preferred embodiment of the present invention, showing the lifting rail moved to about the upper limit position.
Figure 6:
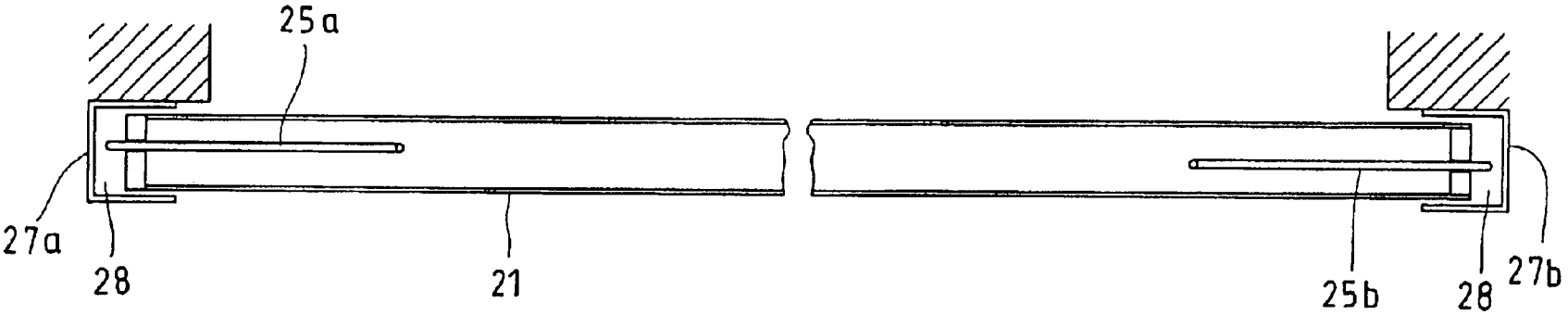
FIG. 6 is a sectional view in an enlarged scale taken along line 6—6 of FIG. 4
Figure 7:
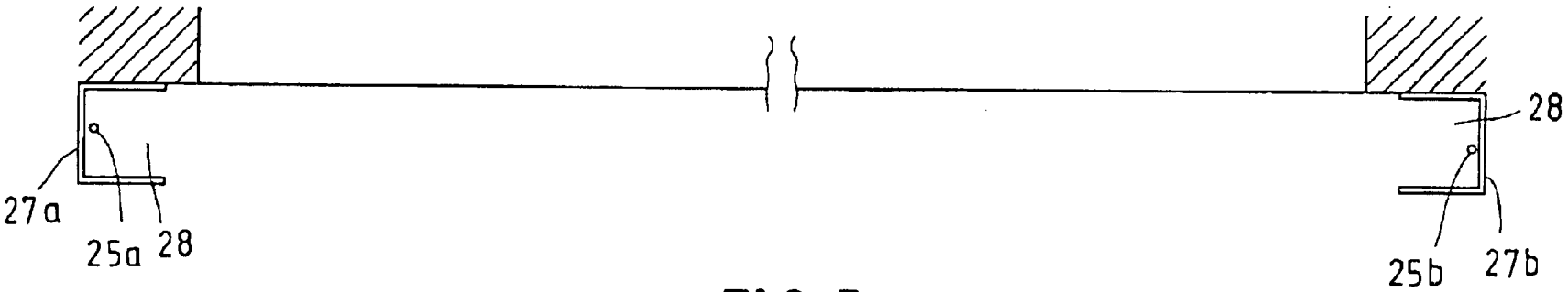
FIG. 7 is a sectional view taken along line 7—7 of FIG. 5.
Figure 8:
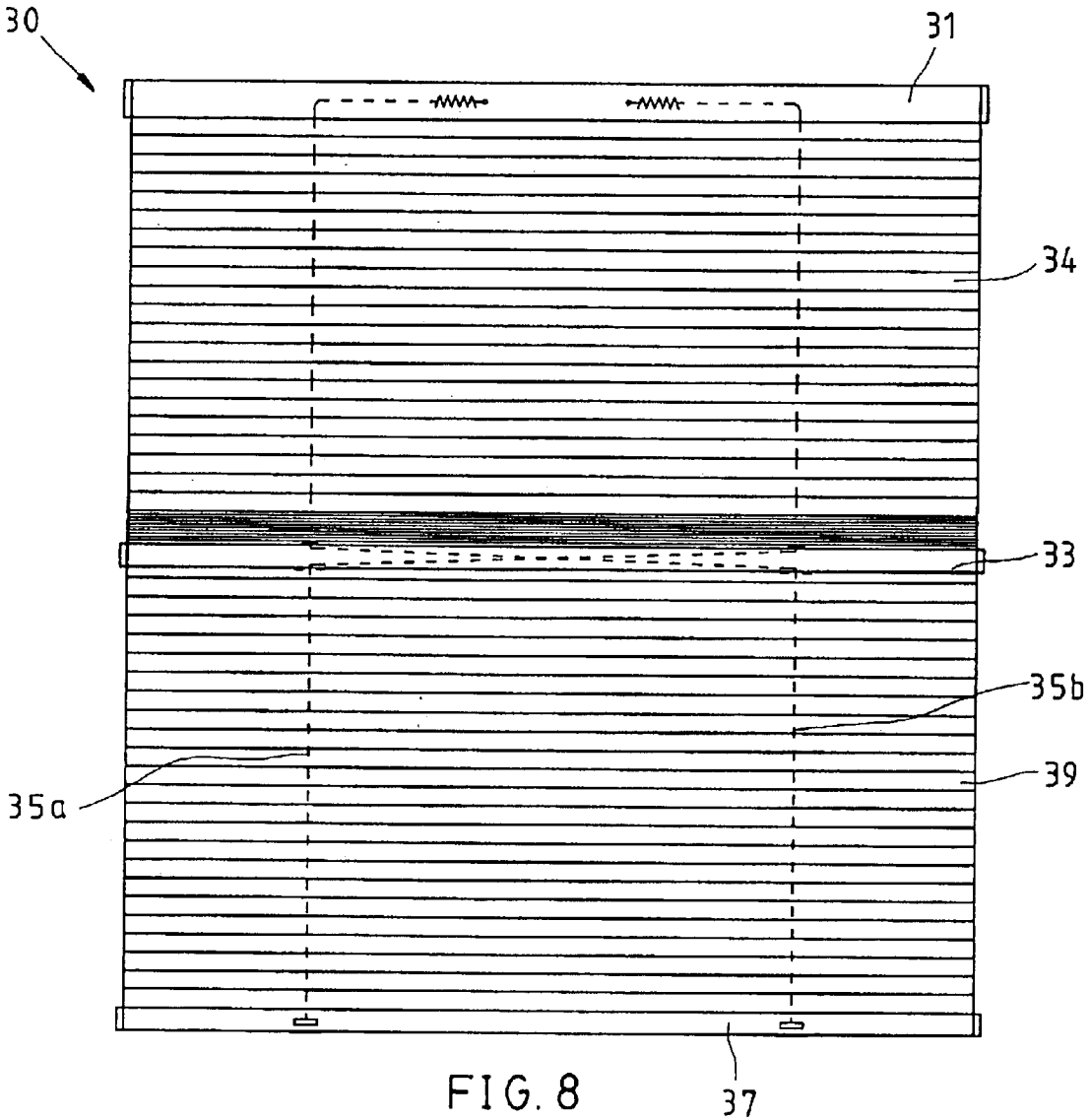
FIG. 8 is a schematic structural view of the third preferred embodiment of the present invention, showing the lifting rail moved to about the mid point position.

FIGS. 4–7 show a vertical retractable blind 20 constructed according to the second preferred embodiment of the present invention. According to this embodiment, the vertical retractable blind 20 is comprised of a headrail 21, a lifting rail 23, a blind body 24 provided between the headrail 21 and the lifting rail 23, and two positioning cords 25*a* and 25*b* adapted to hold the lifting rail 23 at the desired elevation. The major parts of this second embodiment are same as the equivalent parts of the aforesaid first embodiment. The main features of this embodiment are outlined hereinafter. As shown in FIG. 4, the vertical retractable blind 20 further comprises two vertical guide rails 27*a* and 27*b* fixedly provided at two sides of the window. Each of the vertical guide rails 27*a* and 27*b* has a top end close to the headrail 21 and a bottom end slightly lower than the bottom side of the window. As shown in FIG. 6, the vertical guide rails 27*a* and 27*b* each have a longitudinal guide groove 28 facing each other and adapted to receive the ends of the lifting rail 23 and to guide vertical movement of the lifting rail 23 along the vertical guide rails 27*a* and 27*b* (see FIG. 6).

The rear (bottom) ends of the positioning cords 25*a* and 25*b* are extended out of the lifting rail 23 into the longitudinal guide grooves 28 of the vertical guide rails 27*a* and 27*b*, and then extended vertically downwards along the longitudinal guide grooves 28 of the vertical guide rails 27*a* and 27*b*, and finally fixedly fastened to the bottom ends of the longitudinal guide grooves 28 of the vertical guide rails 27*a* and 27*b*.

During retractable or extending action of the blind body 24, the lifting rail 23 is maintained horizontal between the vertical guide rails 27*a* and 27*b* (see FIGS. 5 and 6), therefore the blind body 24 does not fly in the wind and, can smoothly be folded up or extended out. In other words, the protruded portions of the positioning cords 25*a* and 25*b* outside the lifting rail 23 are maintained extended along the longitudinal grooves 28 of the vertical guide rails 27*a* and 27*b* (see FIG. 7), i.e., the protruded portions of the positioning cords 25*a* and 25*b* outside the lifting rail 23 are surrounded by the vertical guide rails 27*a* and 27*b* and protected out of reach of children or external bodies.

According to this embodiment, the first positioning cord 25*a* is extended from the connecting end of the first extension spring 22*a* leftwards in the headrail 21 for a certain distance and then extended vertically downwardly out of the headrail 21, and then vertically extended through the blind body 24 (without affecting the retractable action of the blind body 24) into the inside of the lifting rail 23, and then extended horizontally leftwards out of the left end of the lifting rail 23 into the longitudinal groove 28 of the first (left) vertical guide rail 27*a*, and then extended longitudinally downwards along the longitudinal groove 28 of the first (left) vertical guide rail 27*a*, and finally fixedly fastened to the bottom end of the of the longitudinal groove 28 of the first (left) vertical guide rail 27*a*. The second positioning cord 25*b* is extended from the connecting end of the second extension spring 22*b* rightwards in the headrail 21 for a certain distance and then extended vertically downwardly out of the headrail 21, and then vertically extended through the blind body 24 (without affecting the retractable action of the blind body 24) into the inside of the lifting rail 23, and then extended horizontally rightwards out of the right end of the lifting rail 23 into the longitudinal groove 28 of the second (right) vertical guide rail 27*b*, and then extended longitudinally downwards along the longitudinal groove 28 of the second (right) vertical guide rail 27*b*, and finally fixedly fastened to the bottom end of the of the longitudinal groove 28 of the second (right) vertical guide rail 27*b*.

FIGS. 8–11 show a vertical retractable blind 30 constructed according to the third embodiment of the present invention. The vertical retractable blind 30 is comprised of a headrail 31, a lifting rail 33, a bottom rail 37, a blind body 34 provided between the headrail 31 and the lifting rail 33, and two positioning cords 35*a* and 35*b* adapted to hold the lifting rail 33 at the desired elevation. The major parts of this second embodiment are same as the equivalent parts of the aforesaid first embodiment. The main features of this embodiment are outlined hereinafter.

The vertical retractable blind 30 further comprises a supplementary blind body 39 connected between the lifting rail 33 and the bottom rail 37. The supplementary blind body 39 can be constructed subject to the design of a Venetian blind, pleated blind, honeycomb shade, or the like. According to this embodiment, the supplementary blind body 39 is constructed subject to the design of a honeycomb shade (see FIG. 11).

Figure 9:
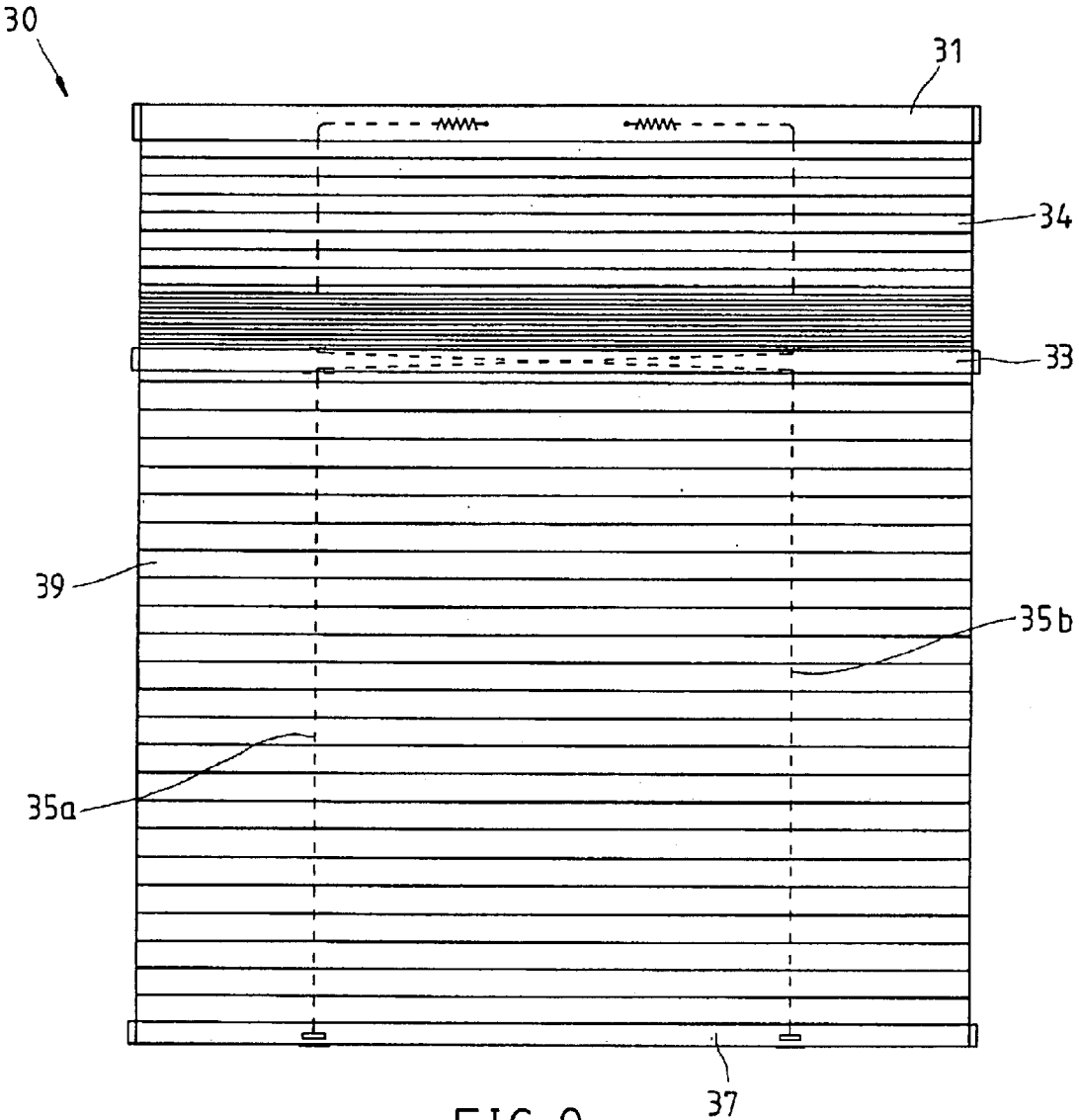
FIG. 9 is another schematic structural view of the third preferred embodiment of the present invention, showing the lifting rail moved to about the upper position.
Figure 10:
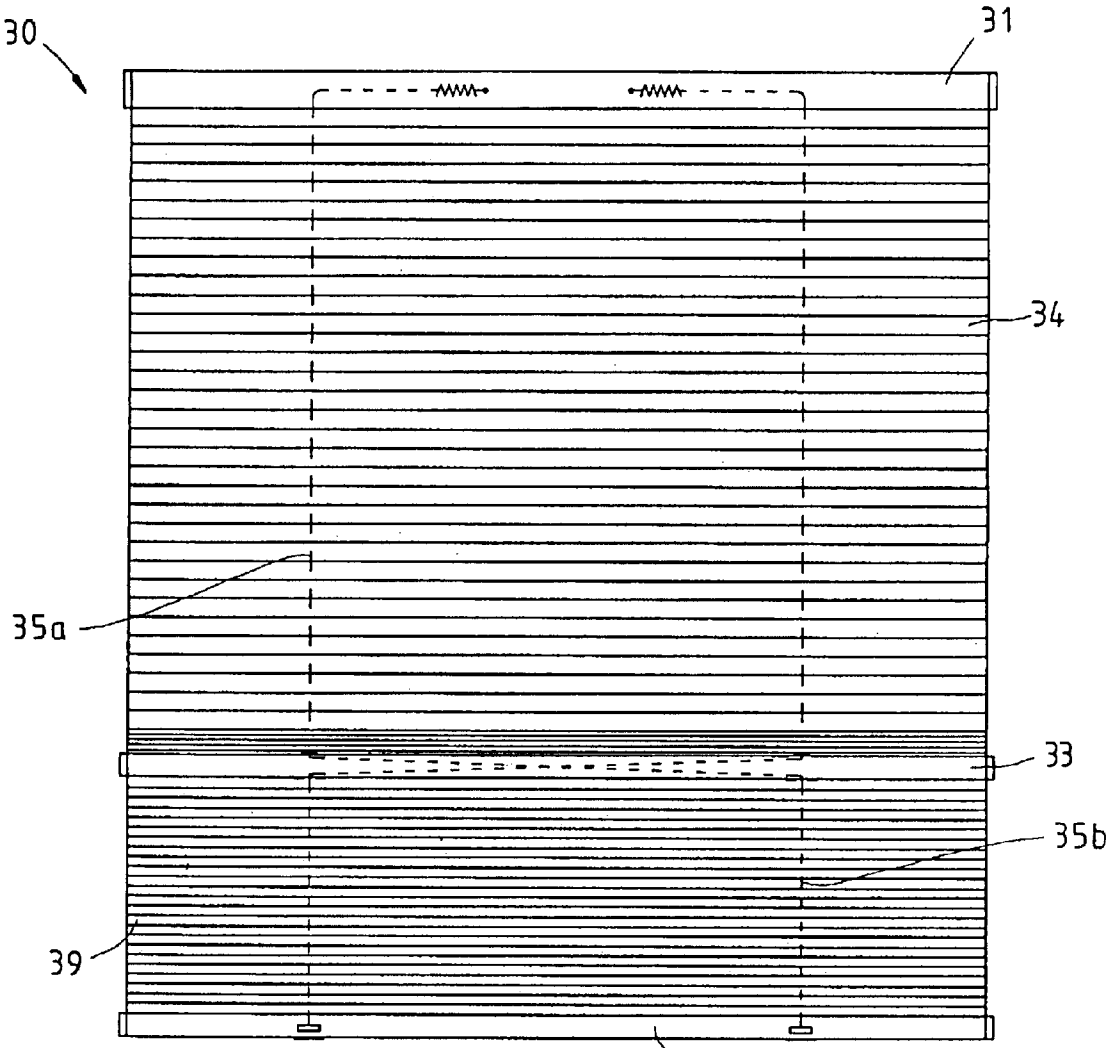
FIG. 10 is still another schematic structural view of the third preferred embodiment of the present invention, showing the lifting rail moved to about the lower position.
Figure 11:
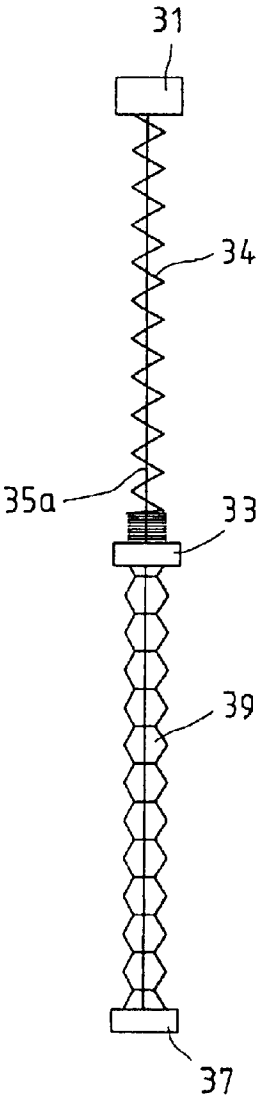
FIG. 11 is a side view of the third preferred embodiment of the present invention.

As illustrated, the vertical retractable blind 30 comprises a first blind body 34 provided between the headrail 31 and the lifting rail 33, and a second blind body 39 provided between the lifting rail 33 and the bottom rail 37. The first blind body 34 and the second blind body 39 can be of different designs for different purposes (for example, the first blind body is a pleated blind and the second blind body is a honeycomb blind as shown in FIG. 11). Further, when lifting the lifting rail 33 to receive the first blind body 34, the second blind body 39 is extended out as shown in FIG. 9. On the contrary, when lowering the lifting rail 33, the first blind body 34 is extended out, and the second blind body 39 is received. In short, the user can adjust the elevation of the lifting rail 33 to change the relative area ratio between the first blind body 34 and the second blind body 39 (when the lifting rail 33 lowered to the lower limit or upper limit position, the vertical retractable blind 30 works as a blind having a single blind body).

A blind made according to either of the aforesaid embodiments is safe in use because the positioning cords are kept out of reach of children. Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A vertical retractable blind for installation to a window for regulating light, comprising:

a headrail transversely fastenable to a top side of a window;

a lifting rail extended in transverse direction below said headrail and vertically movable relative to said headrail;

two positioning cords, said positioning cords each having a first end connected to said headrail and a second end respectively extended across said lifting rail and fixedly secured to a respective fixed point outside said lifting rail to provide a tension force to said lifting rail;

a blind body connected between said headrail and said lifting rail and vertically extended out/received subject to vertical movement of said lifting rail, said main blind body having a plurality of transverse pleats arranged in parallel;

two vertical guide rails vertically arrangeable in parallel at two opposite lateral sides of a window;

the second ends of said positioning cords are respectively fixedly fastened to said vertical guide rails;

said vertical guide rails each have a longitudinal groove facing each other; and the second ends of said positioning cords are respectively fixedly fastened to a bottom end of the longitudinal groove of each of said vertical guide rails.

2. The vertical retractable blind as claimed in claim 1, further comprising a bottom rail extended in transverse direction fixedly provided below said lifting rail to secure the second ends of said positioning cords fixedly.

3. The vertical retractable blind as claimed in claim 2, further comprising a supplementary blind body coupled between said lifting rail and said bottom rail.

4. The vertical retractable blind as claimed in claim 1, wherein the second ends of said positioning cords are respectively fixedly fastened to a wall outside the vertical retractable blind.

5. The vertical retractable blind as claimed in claim 1, wherein said positioning cords include a left positioning cord and a right positioning cord, the second end of said left positioning cord being vertically inserted into said lifting rail and then extended rightwards out of a right end of said lifting rail and then fixedly fastened to the respective fixed point outside said lifting rail, the second end of said right positioning cord being vertically inserted into said lifting rail and then extended leftwards out of a left end of said lifting rail and then fixedly fastened to the other respective fixed point outside said lifting rail.

6. The vertical retractable blind as claimed in claim 1, wherein said positioning cords include a left positioning cord and a right positioning cord, the second end of said left positioning cord being vertically inserted into said lifting rail and then extended leftwards out of a left end of said lifting rail and then fixedly fastened to the respective fixed point outside said lifting rail, the second end of said right positioning cord being vertically inserted into said lifting rail and then extended rightwards out of a right end of said lifting rail and then fixedly fastened to the other respective fixed point outside said lifting rail.

7. The vertical retractable blind as claimed in claim 1, wherein headrail comprises two extension springs, said extension springs each having a first end fixedly fastened to a part inside said headrail and a second end connected to the first end of one of said positioning cords.

8. The vertical retractable blind as claimed in claim 1, further comprising two fixed tension control members respectively connected to the second ends of said positioning cords and adapted to adjust the tension of said positioning cords.

9. The vertical retractable blind as claimed in claim 1, wherein said lifting rail has two distal ends respectively perpendicularly inserted into the longitudinal groove of each of said vertical guide rails for enabling said lifting rail to be moved vertically along said vertical guide rails.

* * * * *